United States Patent [19]

Salmi

[11] 4,289,209

[45] Sep. 15, 1981

[54] IMPACT DEVICE WITH FLUID TOOL ROTATION MOTOR

[75] Inventor: Pekka Salmi, Tampere, Finland

[73] Assignee: Oy Tampella AB, Finland

[21] Appl. No.: 64,649

[22] Filed: Aug. 7, 1979

[30] Foreign Application Priority Data

Aug. 8, 1978 [FI] Finland ..... 782422

[51] Int. Cl.[3] ..... B25D 16/00; B25D 9/12

[52] U.S. Cl. ..... 173/107

[58] Field of Search ..... 173/107, DIG. 3, 106, 173/105, 104, DIG. 4; 91/300, 276

[56] References Cited

U.S. PATENT DOCUMENTS

| | | | |
|---|---|---|---|
| 871,594 | 11/1907 | Jones | 173/107 |
| 1,080,880 | 12/1913 | Bayles | 173/107 |
| 1,464,809 | 8/1923 | Curti | 173/107 |
| 3,741,316 | 6/1973 | Alajouanine | 173/107 |
| 3,822,752 | 7/1974 | Montabert | 173/106 |
| 4,039,033 | 8/1977 | Salmi | 173/105 |
| 4,103,746 | 8/1978 | Reynolds | 173/107 |

*Primary Examiner*—Werner H. Schroeder
*Assistant Examiner*—Andrew M. Falik
*Attorney, Agent, or Firm*—Hill, Van Santen, Steadman, Chiara & Simpson

[57] ABSTRACT

A drilling machine including a rock drill comprising a striking piston fitted to reciprocate in a cylinder. The piston is driven by a pressure medium. A rotation motor is provided and is driven by a pressure medium. A pump piston is permanently connected to a striking piston in concentric relation and arranged to travel in a pump cylinder. The cylinder is concentric with the cylinder that operates the striking piston and is axially spaced therefrom. The pump piston is arranged to provide a pump pressure medium to the rotation motor.

8 Claims, 2 Drawing Figures

IMPACT DEVICE WITH FLUID TOOL ROTATION MOTOR

This invention relates to a drilling machine, especially a rock drill comprising a striking machine which is driven by a pressure medium, and a rotation motor which is driven by pressure fluid. The invention relates to both pneumatic and hydraulic rock drills. In case a separate rotation motor has been used in the former ones, it has usually been pneumatic. In the latter ones a separate hydraulic rotation motor has usually always been used. The object of the invention is to couple the operation of the striking machine and the rotation motor together in a new way so that the efficiency of the drilling machine is improved and the construction of the machine becomes simplier and more advantageous.

In order to reach this object the invention is characterized in that the striking piston of the striking machine is arranged to pump the pressure fluid needed by the rotation motor. The pneumatic drilling machine now can be lubricated with the pressure fluid of the rotation motor, and it is not necessary to add oil to air used to operate the striking mechanism. Compared with known drilling machines which are equipped with a separate hydraulic motor, the invention offers the following advantages: (1) The herein disclosed solution is less expensive because no separate hydraulic pump is needed; (2) Only short channels are needed in the rotation circuit; (3) The long striking piston is preferable to transfer the striking energy to the rock. By this adaptation of hydraulics according to the invention the efficiency of known pneumatic machines can be improved.

With reference to the accompanying drawings, an embodiment of the invention has been described in more detail.

Figure 1:
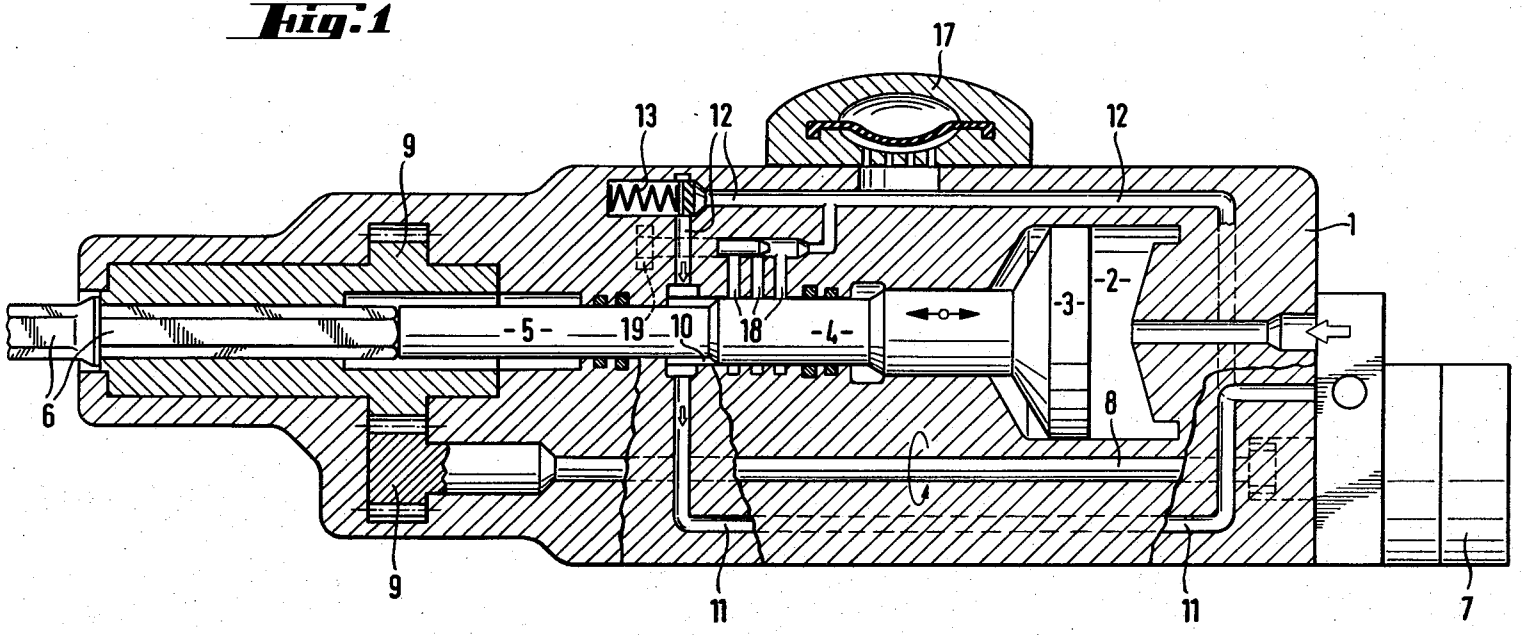
FIG. 1 shows a schematic longitudinal sectional view of a rock drill according to the invention.
Figure 2:
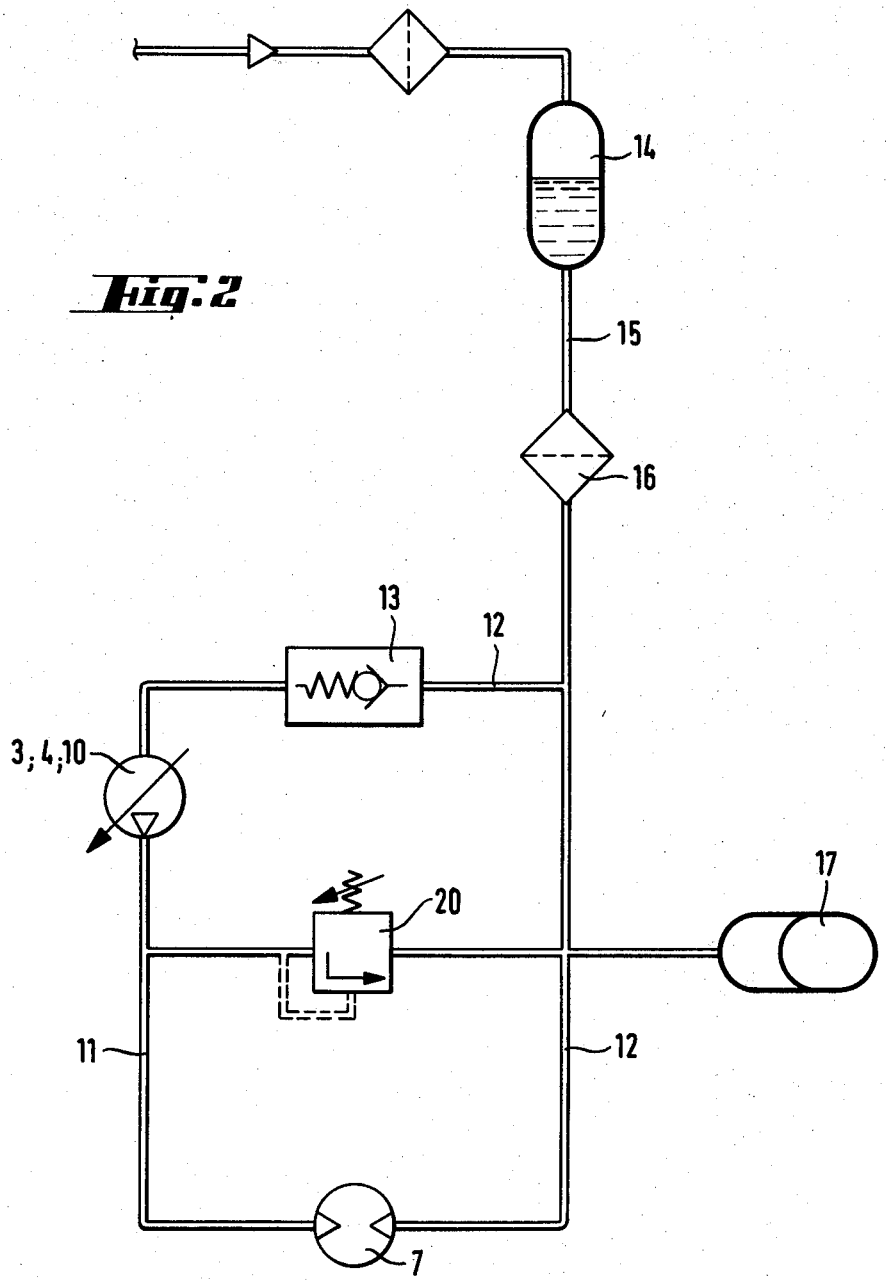
FIG. 2 shows a simplified hydraulic scheme for the rock drill

In FIG. 1 and FIG. 2 same parts are marked with same reference numbers. Number 1 refers to the body of the rock drill. Within the body there is a cylinder 2 of the striking machine, in which cylinder a striking piston 3 is moved to and fro in the known way (see U.S. Pat. No. 4,028,995) by means of a pressure fluid. The striking energy of the striking piston 3 is transferred to a tool 6 through the striking end 5 of the piston. A rotation motor 7 transfers the rotation movement by means of a rod 8 and gears 9 over to the tool 6. The striking piston 3 is caused to reciprocate by the aid of pressure oil fed through channels (not shown) in an annular distributing valve (not shown) slidably surrounding the piston 3, as is well known in the art and described in more detail in U.S. Pat. No. 4,028,995. During its movement backwards (from left to right) the striking piston 3 pulls the pump piston 4 (which is integral and concentric with the striking piston 3), outwards in the pump cylinder 10, which is filled by oil through channel 12 partly from the output of the rotation motor 7 and partly from the pressure accumulator 17. When the pistons 3 and 4 are moving forward, the pressure increases in the pump cylinder 10 and since the back valve 13 prevents the oil from flowing back to the suction channel 12, the oil is pressed to an input side of rotation motor 7 to cause its rotation. During this latter half of the reciprocation cycle of the pistons 3 and 4, the oil from the output of the rotation motor 7 is fed to pressure accumulator 17.

In the striking piston 3 there is also a pump piston 4 which moves in a pump cylinder 10. The pump cylinder 10 is connected with the rotation motor 7 by a pressure channel 11 and, through a back pressure valve 13, by a suction channel 12. The pump piston 4 sucks the pressure fluid for the rotation motor from the suction channel 12 and forces it into the pressure channel 11 and the rotation motor 7. The object of the back pressure valve 13 is to prevent the flow of pressure fluid back into the suction channel 12 during the work stroke of the pump piston 4. The channels 11 and 12 form a closed circuit which is filled from a pressurized pressure fluid tank 14 (FIG. 2) from which pressure fluid is led into the drilling machine by means of a hose 15 through a pressure fluid filter 16. The tank 14 can be located away from the drilling machine.

The operations of the striking piston 3 and thus also the pumping of the pump piston 4 are cyclical and operable through a rotation circuit 11, 7, 12. This circuit has been provided with a pressure accumulator 17. In the drawings the pressure accumulator 17 is placed in the suction channel 12 of the pump cylinder 10.

In order to adjust the speed of rotation, there are by-channels 18 between the pump cylinder 10 and its suction channel 12. The by-channels 18 can be closed and opened by means of a spindle 19. The more of the channels 18 that are open, the more the rotation effect decreases because the more pressure fluid can flow back into the suction channel 12 during the work stroke of the pump piston 4. By closing the by-channels 18 the maximum speed of rotation is achieved, because then all pressure fluid sucked by the pump piston 4 is forced into the pressure channel 11. Between the pressure channel 11 and the suction channel 12 there is a pressure balancing valve 20 (FIG. 2), which valve restricts the torsional moment of the rotation motor thus protecting the rotation motor and the tool 5,6.

It is also obvious that if the resistance to rotate increases, for example when the tool is about to get jammed in the rock, then the pressure rises also below the pump piston in the pump cylinder 10, which lightens the work stroke of the striking piston 3. This is preferable in order to prevent the jamming of the tool.

Stated in another way, the pump cylinder 10 feeds pressure fluid through channel 11 to the rotation motor 7. If the rotation resistance increases, it is obvious that the feeding pressure of the pressure fluid in channel 11 and also in pump cylinder 10 increases. The increased pressure in cylinder 10 counteracts the striking movement and lightens the work stroke of the striking piston 3. When the rotation resistance is increased, the striking force is decreased. In view of the above description, and in view of the operational description contained in U.S. Pat. No. 4,028,995, it is believed the best mode of operation should be clearly understood to a person skilled in the art.

I claim:

1. A rock drilling machine including a cylinder and a striking piston fitted to reciprocate therein in response to a pressure medium travelling through a first duct, a rotation motor drivable by a pressure medium travelling through a second duct, wherein said first and second ducts are not connected, a pump piston and a pump cylinder with the pump piston arranged to travel in the pump cylinder and being permanently connected to the striking piston, the pump cylinder being concentric with the cylinder carrying said striking piston and being positioned at an axial distance therefrom, said pump piston being arranged to pump pressure medium to said rotation motor during a work stroke of the striking piston.

2. A drilling machine according to claim 1, wherein there are by-channels (18) in the pump cylinder (10) to adjust the speed of rotation, which channels can be closed and opened.

3. A drilling machine according to claim 2, wherein the by-channels (18) join a channel (12) in an outlet side of the rotation motor, which channel (12) is connected to a suction side of the pump cylinder (10).

4. A drilling machine according to claim 1, wherein there are by-channels in the pump cylinder of the striking piston to adjust the speed of rotation, which channels can be closed and opened, the by-channels join a channel in an outlet side of the rotation motor, which channel is connected to a suction side of the pump cylinder of the striking piston.

5. A drilling machine according to claim 4, wherein there is a pressure accumulator (17) in the channel (12) of the outlet side of the rotation motor which channel joins the suction side of the pump cylinder (10).

6. A drilling machine according to claim 4, wherein the pump cylinder (10) and the rotation motor (7) are joined together by a closed flow circuit, the pressure channel (11) of which is connected to the suction channel (12) over a pressure limit valve (20).

7. A drilling machine according to claim 4, wherein the pump piston (4) is extended by a striking end (5) which transfers the striking energy to a tool (6).

8. In a rock drilling mechanism including a housing with a first cylinder formed therein, a striking piston adapted to move axially in a first direction a limited distance and opposite the first direction the limited distance in the first cylinder in response to a first pressure medium, a striking member affixed to the striking piston, the striking member is moved axially by the striking piston and is adapted to move in the first direction to strike a tool affixable to the housing, the tool is movable axially and rotatably when affixed to the housing, a rotation motor adapted to rotate the tool when the tool is affixed to the housing, an improvement comprising:

a second cylinder, formed in the housing and axially displaced with respect to the first cylinder;

a pump piston affixed to the striking piston and displaced axially with respect thereto, said pump piston is adapted to be moved axially in said second cylinder by the striking piston;

means for supplying a quantity of a second pressure medium to said second cylinder as said pump piston is moved axially opposite the first direction;

means for supplying a quantity of the second pressure medium in said second cylinder to the rotation motor when said pump piston is moved axially in the first direction.

* * * * *